US008349088B1

(12) United States Patent
Miner

(10) Patent No.: US 8,349,088 B1
(45) **Date of Patent: *Jan. 8, 2013**

(54) EXTRACTION CLEANING WITH ALTERNATING FLUID DISTRIBUTION

(75) Inventor: Jonathan L. Miner, Rockford, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 390 days.

This patent is subject to a terminal disclaimer.

(21) Appl. No.: 12/389,948

(22) Filed: Feb. 20, 2009

Related U.S. Application Data

(63) Continuation of application No. 11/275,472, filed on Jan. 6, 2006, now Pat. No. 7,904,990.

(60) Provisional application No. 60/593,360, filed on Jan. 7, 2005.

(51) Int. Cl.
*B08B 5/04* (2006.01)

(52) U.S. Cl. ..... 134/21; 134/10; 134/169 C; 15/421

(58) Field of Classification Search ..... 134/169 C, 134/21, 10; 15/421
See application file for complete search history.

(56) References Cited

U.S. PATENT DOCUMENTS

| | | | | |
|---|---|---|---|---|
| 4,014,067 | A * | 3/1977 | Bates | 15/320 |
| 4,167,799 | A * | 9/1979 | Webb | 15/320 |
| 4,295,243 | A * | 10/1981 | King | 15/320 |
| 5,237,720 | A | 8/1993 | Blase et al. | |
| 6,131,237 | A * | 10/2000 | Kasper et al. | 15/320 |
| 6,453,506 | B1 * | 9/2002 | Sumner | 15/322 |
| 6,513,188 | B2 | 2/2003 | Zahuranec et al. | |
| 6,681,442 | B2 * | 1/2004 | Coates et al. | 15/320 |
| 7,392,566 | B2 * | 7/2008 | Gordon et al. | 15/319 |
| 2002/0092115 | A1 * | 7/2002 | Zahuranec et al. | 15/320 |
| 2003/0159232 | A1 * | 8/2003 | Hekman et al. | 15/320 |
| 2005/0091782 | A1 * | 5/2005 | Gordon et al. | 15/320 |

* cited by examiner

*Primary Examiner* — Michael Kornakov
*Assistant Examiner* — Katelyn Whatley
(74) *Attorney, Agent, or Firm* — McGarry Bair PC

(57) ABSTRACT

A method of surface cleaning wherein recovering a soiled cleaning fluid from a surface to be cleaned is subsequent to the application of fluid to the surface as a module moves along different and opposite directions.

12 Claims, 5 Drawing Sheets

EXTRACTION CLEANING WITH ALTERNATING FLUID DISTRIBUTION

CROSS-REFERENCE TO RELATED APPLICATIONS

This application is a continuation of U.S. application Ser. No. 11/275,472, filed Jan. 6, 2006, now U.S. Pat. No. 7,904,990, issued Mar. 15, 2011, which claims the benefit of U.S. provisional application Ser. No. 60/593,360, filed Jan. 7, 2005, both of which are incorporated by reference herein in their entirety.

BACKGROUND OF THE INVENTION

1. Field of the Invention

This invention relates to extraction cleaning. In one of its aspects, the invention relates to extraction cleaning with enhanced cleaning performance. In another of its aspects, the invention relates to an extraction cleaning machine wherein the dwell time for cleaning fluid applied to a surface to be cleaned is constant regardless of the direction of movement of the cleaning machine. In another of its aspects, the invention relates to a method for cleaning a carpet or other floor surface wherein a cleaning module with a suction nozzle is moved forwardly and rearwardly along the surface to be cleaned and cleaning fluid is applied to the surface after suction is applied to the surface to equalize the dwell time of the cleaning fluid regardless of the direction of movement of the cleaning module along the surface to be cleaned.

2. Description of the Related Art

Extraction cleaning machines have been used for removing dirt from surfaces such as carpeting and hard surface floors. The extraction cleaning machines can be in the form of a canister-type unit, as disclosed in U.S. Pat. No. 5,237,720 to Blase et al., or an upright unit, as disclosed in U.S. Pat. No. 6,131,237 to Kasper et al.

Either type of unit contains a fluid delivery system for depositing a quantity of cleaning solution on the surface through a spray dispenser assembly. The cleaning solution dissolves the dirt, removes the dirt from the surface to be cleaned, and places the dirt in suspension, which aids in the vacuum removal of the dirt from the surface. After a period of time, the cleaning solution is removed through a vacuum process. The longer the cleaning solution remains on the surface, the more effective the cleaning solution is in cleaning the surface.

Conventional extraction cleaning machines have a spray dispenser assembly which is typically adjacent to and to the rear of the suction nozzle. As the extraction cleaning machine is moved in a forward direction, the cleaning fluid will be deposited on the surface to be cleaned behind the suction nozzle, leaving a wetted surface behind it. When the extraction cleaning machine is moved rearwardly, the suction nozzle trails the spray dispenser and removes the cleaning fluid almost as soon as it is applied to the surface. Consequently, the cleaning solution has a different dwell time on the surface between the forward and rearward stroke of the machine. Further, the surface is scrubbed with a brush in the forward direction after the cleaning solution is deposited and is scrubbed with a brush before application of the cleaning solution on the rearward stroke. Accordingly, the cleaning fluid may not remain on the surface to be cleaned a sufficient time to most effectively clean the surface on the rearward stroke of the machine.

U.S. Pat. No. 4,014,067 to Bates discloses a carpet cleaner having a pair of spray dispensers on either side of a scrubbing brush and behind the suction nozzle.

U.S. Pat. No. 6,681,442 to Coates et al., issued Jan. 27, 2004, discloses an extractor having a spray dispenser for depositing different liquids to a surface wherein the liquid delivery is controlled by the direction of movement of the extractor.

SUMMARY OF THE INVENTION

A method for treating a surface upon which a body can be supported according to the invention includes the steps of applying a first quantity of fluid to the surface along a first direction, subsequently applying a second quantity of fluid to the surface along a second direction generally opposite the first direction, extracting only the first quantity of fluid from the surface along the second direction contemporaneously with applying the second quantity of fluid and leaving the second quantity of fluid on the surface along the second direction, and extracting only the second quantity of fluid from the surface along the first direction contemporaneously with applying of the first quantity of fluid and leaving the first quantity of fluid on the surface along the first direction.

Further according to the invention, a method for cleaning a surface upon which a body can be supported of dirt and debris includes the steps of sequentially moving a cleaning module along the surface in a first direction and along the surface in a second direction generally opposite the first direction, sequentially applying first and second volumes of cleaning fluid directly to a portion of the surface while the cleaning module sequentially moves along the portion of the surface in the first and second directions, respectively, allowing the dirt and debris to be treated with the first and second volumes of cleaning fluid to facilitate removal of the dirt and debris from the portion of the surface, while the cleaning module moves along the portion of the surface in the first direction, recovering dirt, debris, and only the second volume of cleaning fluid previously applied to the portion of the surface during the movement of the cleaning module in the second direction, and while the cleaning module moves along the portion of the surface in the second direction, recovering dirt, debris, and only the first volume of cleaning fluid previously applied to the portion of the surface during the movement of the cleaning module in the first direction.

Further according to the invention, a method for treating a surface upon which a body can be supported includes the steps of traversing a portion of the surface along a first direction while applying a first volume of fluid to the portion of the surface, subsequently traversing the portion of the surface along a second direction generally opposite the first direction while applying a second volume of fluid to the portion of the surface, while traversing the portion of the surface along the first direction and applying the first volume of fluid to the portion of the surface, contemporaneously extracting only fluid applied to the portion of the surface while traversing along the second direction, and while traversing the portion of the surface along the second direction and applying the second volume of fluid to the portion of the surface, contemporaneously extracting only fluid applied to the portion of the surface while traversing along the first direction.

DESCRIPTION OF AN EMBODIMENT OF THE INVENTION

Figure 1:
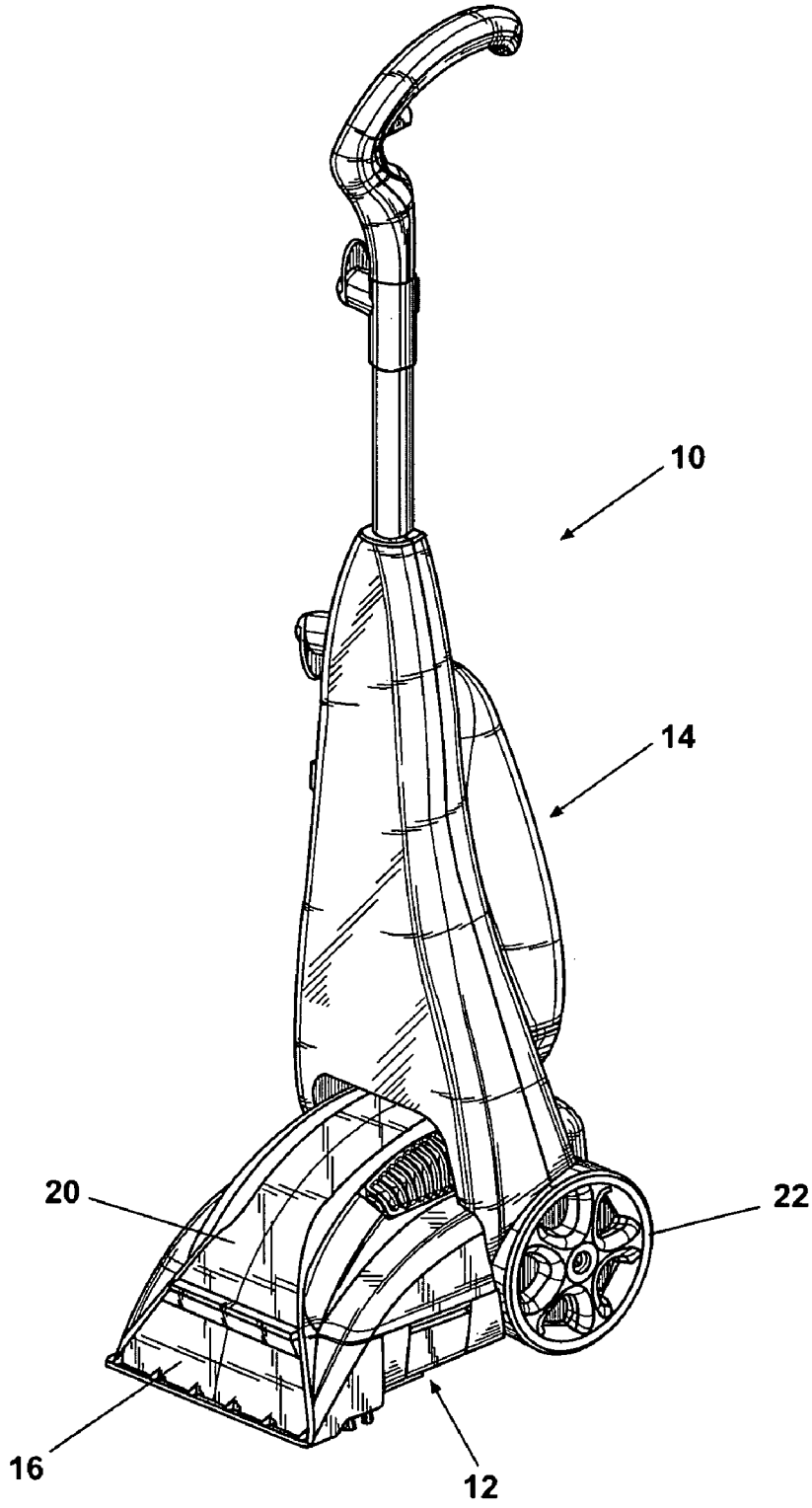
FIG. 1 is a perspective view of an upright extraction cleaning machine according to the invention.
Figure 2:
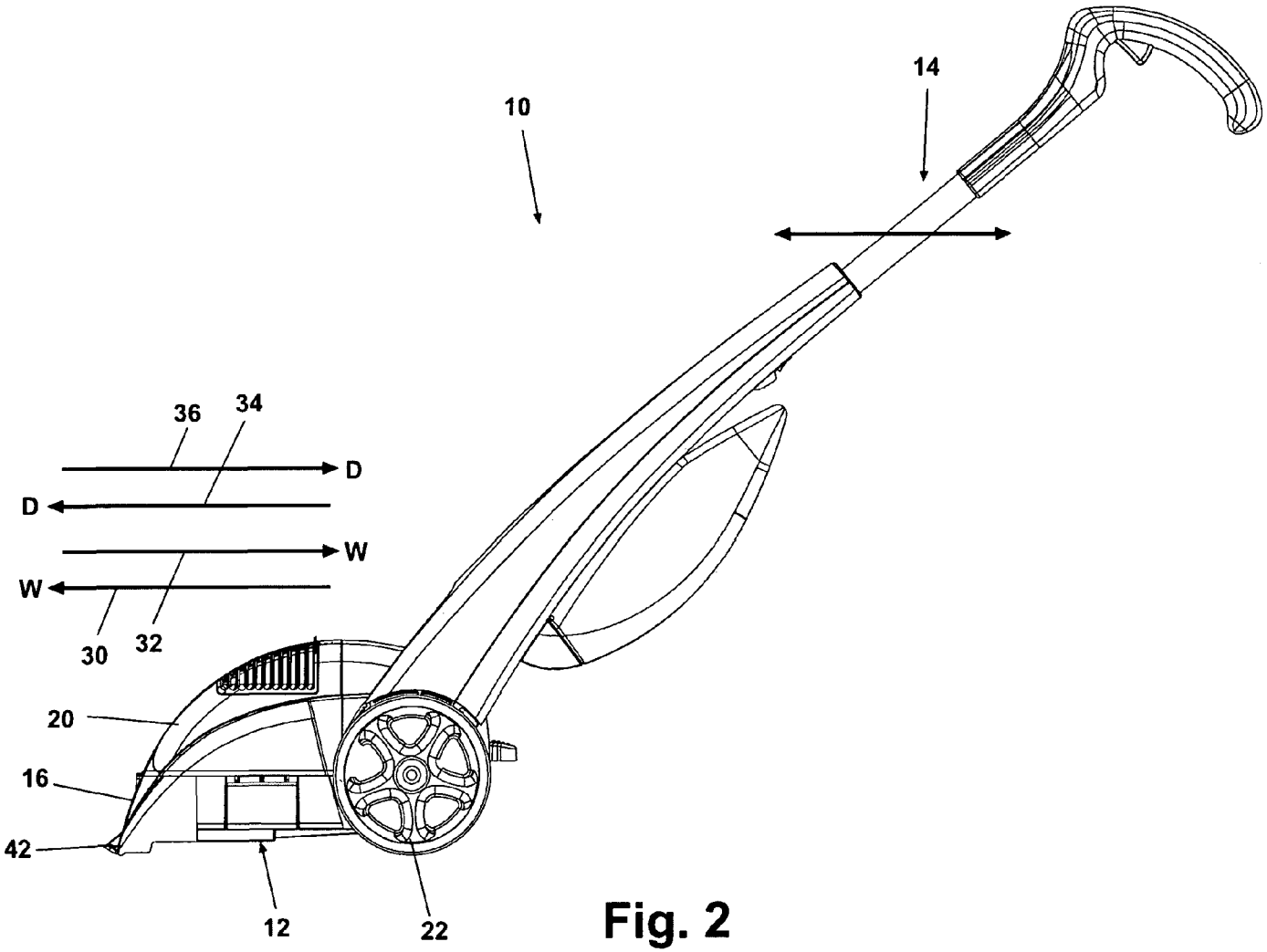
FIG. 2 is a side elevation view of the upright extraction cleaning machine illustrated in FIG. 1 showing movement of the upright extraction cleaning machine during wetting and drying of a surface to be cleaned.

Referring now to the drawings and to FIGS. 1 and 2 in particular, an embodiment of the invention is illustrated comprising a portable extraction cleaning machine 10 having a base module 12 with wheels 22 to support the module 12 for movement along a surface to be cleaned, and an upright handle assembly 14 pivotally mounted to a rear portion of the base module 12 for manipulating the base module 12 for cleaning the surface. The invention is described and illustrated herein with respect to an embodiment comprising an upright extraction cleaning machine, although the invention can also be utilized in a canister-type cleaning machine. The upright extraction cleaning machine 10 is a generally well-known device comprising several of the features and operations described in U.S. Pat. No. 6,131,237 to Kasper et al., which is incorporated herein by reference in its entirety. Such well-known features and operations will not be described in detail herein, except as otherwise necessary for a complete understanding of the invention.

As illustrated in FIG. 2, the extraction cleaning machine 10 is intended to be moved in alternating forward and rearward directions during the cleaning process, as illustrated by the two headed arrow. The typical cleaning process involves a first wetting pass 30 in a forward direction wherein cleaning solution is applied to the surface to be cleaned, followed by a second wetting pass 32 in a rearward direction wherein cleaning solution is again applied to the surface. This movement is followed by a first drying pass 34 in a forward direction wherein the cleaning solution is vacuumed from the surface, and finally a second drying pass 36 in a rearward direction wherein additional vacuuming is performed.

The base module 12 includes a housing 20 having a front portion 16. The housing 20 forms an enclosure for a motor 24 operating a well-known liquid vacuum system (not shown), an agitation assembly 26, a liquid delivery system comprising a plurality of outlet dispensers 40, 42 for applying liquid to the carpet, liquid reservoirs, and the like.

Figure 3:
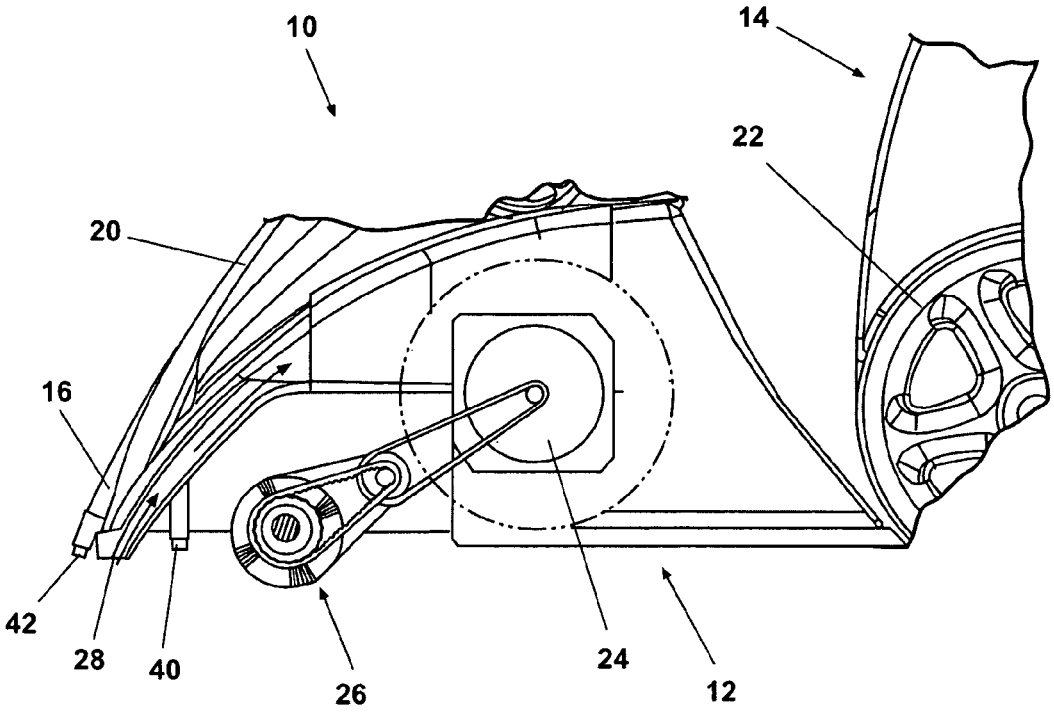
FIG. 3 is a partial sectional side view of the extraction cleaning machine of FIG. 1 illustrating the location of a pair of cleaning fluid spray dispenser assemblies for alternately delivering cleaning fluid to a surface to be cleaned.

As illustrated in FIG. 3, the vacuum system comprises a suction nozzle 28 at the front portion 16 of the housing 20 adapted for vacuum removal of liquid from the surface to be cleaned. Immediately rearward of the suction nozzle 28 is a first assembly of outlet dispensers 40 for spraying cleaning solution onto the surface. The number of outlet dispensers 40 can be selected based upon, for example, the pattern of liquid delivery from each dispenser, the width of the cleaning machine 10, and the desired coverage of the spray pattern from each dispenser 40. The dispensers 40 are fluidly connected in a well-known manner to the fluid delivery system of the extraction cleaning machine 10.

Immediately forward of the suction nozzle 28 is a second assembly of outlet dispensers 42 for spraying cleaning solution onto the surface to be cleaned. The number of outlet dispensers 42 can be selected upon, for example, the pattern of liquid delivery from each dispenser, the width of the cleaning machine 10, and the desired coverage of the spray pattern from each dispenser 42. The dispensers 42 are fluidly connected in a well-known manner to the fluid delivery system of the extraction cleaning machine 10. The dispensers 40, 42 are positioned relative to the suction nozzle 28 so that when the base module 12 is moved in a forward direction, fluid from the first dispenser assembly 40 remains on the surface to be cleaned until the suction nozzle 28 passes over the wetted area during a rearward pass of the base module 12. Similarly, fluid from the second dispenser assembly 42 when the base module 12 is moved in a rearward direction will remain on the surface until the suction nozzle 28 passes over the wetted area during a forward pass of the base module 12.

Figure 4:
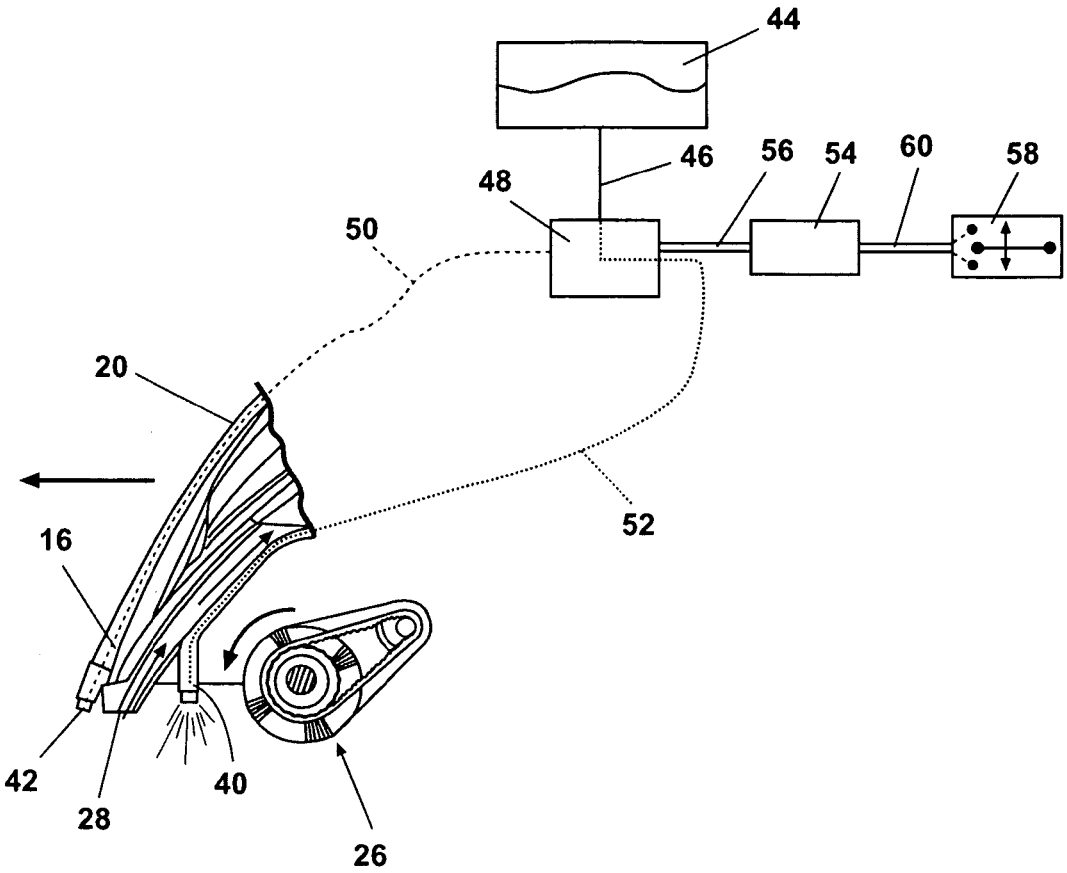
FIG. 4 is a schematic representation of the delivery of cleaning fluid from a first cleaning fluid spray dispenser assembly during forward movement of the extraction cleaning machine of FIG. 1.
Figure 5:
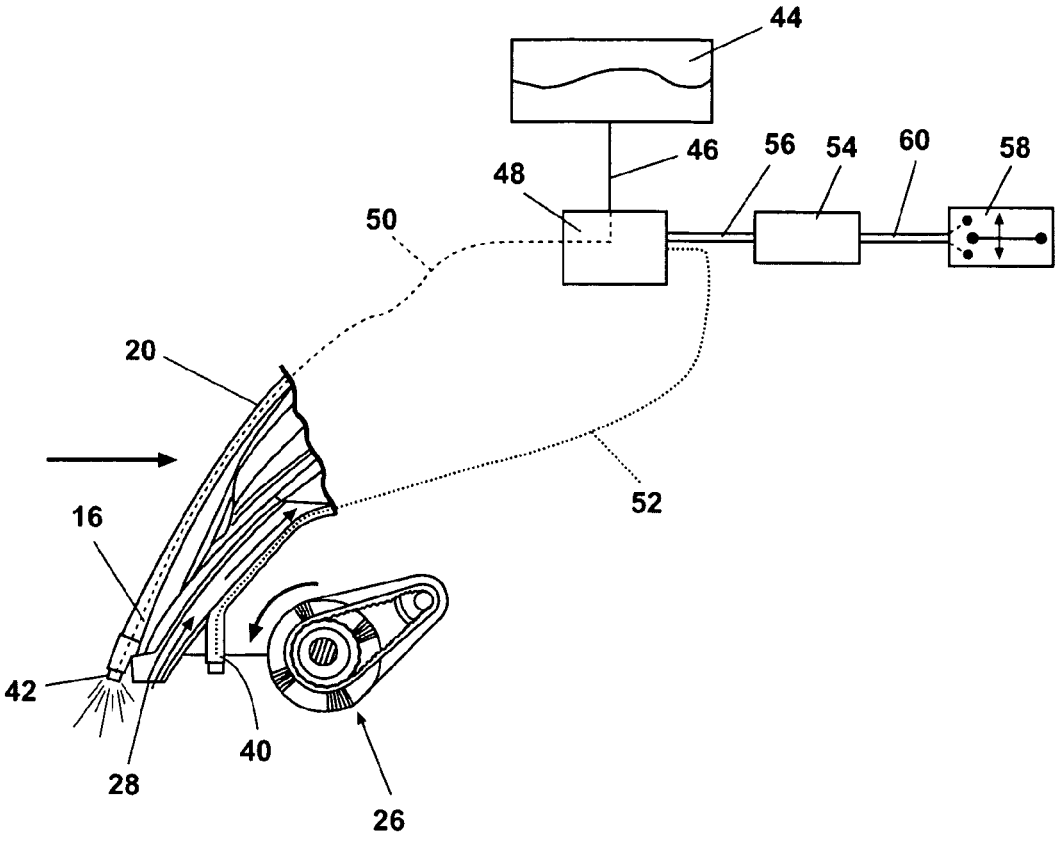
FIG. 5 is a schematic representation of the delivery of cleaning fluid from a second cleaning fluid spray dispenser assembly during rearward movement of the extraction cleaning machine of FIG. 1.

FIGS. 4 and 5 illustrate an embodiment of a dispenser control system for controlling the selective delivery of cleaning fluid to the dispensers 40, 42. It is anticipated that other configurations of a suitable control system would be evident to a person of ordinary skill in the relevant art, and other configurations are possible without departing from the spirit of the invention. The dispensers 40, 42 are fluidly connected to a well-known cleaning fluid reservoir 44. The cleaning fluid reservoir 44 is fluidly connected through a cleaning fluid supply line 46 to a valve 48. The valve 48 can selectively deliver cleaning fluid to the rear outlet dispenser assembly 40 through a rear dispenser supply line 52 or to the forward outlet dispenser assembly 42 through a forward dispenser supply line 50.

The valve 48 is operably connected to a suitable control device 54 through a control connection 56. The control device 54 is capable of operating the valve 48 in response to an input signal corresponding to the selection of the nozzle assembly 40, 42 through which cleaning fluid is to be delivered. The control device 54 is operably connected through a switch connection 60 to a switch 58 which is used to select the dispenser assembly 40, 42 through which cleaning fluid is to be delivered. The switch 58 can comprise a well-known hand-operated toggle switch which can toggle between a first actuating position, a second actuating position, and an off position. The switch 58 can also comprise a mechanism tied to the movement of the base module 12, such as a magnet-based sensor to generate an actuation signal indicating the direction of rotation of the wheels 22 such as a magnet attached to the wheels that moves past a sensor during rotation of the wheels. Similarly, a switch similar to that described in U.S. Pat. No. 6,681,442 to Coates et al. can automatically generate a first control signal when the handle assembly 14 is telescopically moved in a first direction corresponding to forward movement of the base module 12, and a second control signal when the handle assembly 14 is telescopically moved in a second direction corresponding to rearward movement of the base module 12.

As illustrated in FIG. 4, movement of the base module 12 in a forward direction is accompanied by delivery of cleaning fluid from the reservoir 44 to the rear outlet dispenser assembly 40. The cleaning fluid can then be scrubbed into the carpet by the agitation assembly 26. The base module 12 can then be moved in a rearward direction as illustrated in FIG. 5, accompanied by delivery of cleaning fluid from the reservoir 44 to the forward outlet dispenser assembly 42. The previously deposited cleaning fluid from the rear outlet dispenser assembly 40 will be removed from the surface to be cleaned by the vacuum applied through the suction nozzle 28. The cleaning fluid deposited from the forward outlet dispenser assembly 42 will remain on the surface to further loosen and suspend dirt for subsequent removal through the suction nozzle 28 upon a subsequent pass of the base module 12.

The use of dual alternating dispenser assemblies for delivery of cleaning solution to the surface being cleaned can facilitate the cleaning of the surface by leaving cleaning solution on the surface for a longer period of time than with a conventional single fluid dispensing mechanism. Cleaning fluid can be discharged through the rear spray dispensers onto the surface to be cleaned during forward travel of the extraction cleaning machine, to be scrubbed by the agitation assembly. Rearward travel of the extraction cleaning machine will result in the cleaning fluid deposited during the forward pass being extracted through the suction nozzle in a well-known manner. However, additional cleaning fluid will be deposited through the forward spray dispensers during the rearward travel of the extraction cleaning machine, thereby increasing the period of time during which cleaning fluid is applied to the surface being cleaned. This additional time enables the cleaning fluid to more effectively clean the surface.

The use of an automatic dispensing selection switching device can deliver the cleaning solution to the selected dispensing assembly without the necessity of operator input. The use of the switching device will ensure that the cleaning fluid is properly applied to the surface to be cleaned.

With a canister-type cleaning machine having a canister base module and a wand, the liquid vacuum system, the cleaning fluid reservoir 44, the control device 54, and the valve 48 can be housed in the canister. The suction nozzle 28 and the outlet dispensers 40, 42 can be housed in the wand head in a configuration similar to that described and illustrated for the upright extraction cleaning machine 10. The switch 58 can be placed at a suitable position on the wand. Supply lines extending from the wand head to the canister fluidly interconnect the outlet dispensers 40, 42 with the cleaning fluid reservoir 44, the control device 54, and the valve 48.

The switch 58 would be tied to the movement of the wand, rather than the base module. A magnet-based sensor could be tied to the direction of rotation of wheels in the head, such as a magnet attached to the wheel that moves past a sensor during rotation of the wheel. Alternatively, a switch similar to that described in U.S. Pat. No. 6,681,442 to Coates et al. could generate signals corresponding to telescopic movement of the wand in a forward or rearward direction.

While the invention has been specifically described in connection with certain specific embodiments thereof, it is to be understood that this is by way of illustration and not of limitation. For example, the invention has been described with respect to the delivery of cleaning fluid to a floor surface through spray dispensers wherein the cleaning fluid is typically pressurized by a pump. It is within the scope of the invention to deliver the cleaning fluid to the surface to be cleaned by other means, such as a gravity-fed system with distribution bars instead of spray nozzles and a pump.

Reasonable variation and modification are possible within the scope of the forgoing disclosure and drawings without departing from the spirit of the invention which is defined in the appended claims.

What is claimed is:

1. A method for treating a surface upon which a body can be supported, the method comprising the steps of:

applying a first quantity of fluid to the surface along a first direction;

subsequently applying a second quantity of fluid to the surface along a second direction generally opposite the first direction;

extracting only the first quantity of fluid from the surface along the second direction contemporaneously with applying the second quantity of fluid and leaving the second quantity of fluid on the surface along the second direction; and extracting only the second quantity of fluid from the surface along the first direction contemporaneously with applying the first quantity of fluid and leaving the first quantity of fluid on the surface along the first direction.

2. A method for cleaning a surface according to claim 1 wherein the applying and the extracting steps are carried out sequentially in both the first and second directions.

3. A method for cleaning a surface according to claim 1 wherein leaving the first and second quantities of fluid on the surface entrains dirt and debris in at least one of the first and second quantities of fluid.

4. A method for cleaning a surface according to claim 3 wherein the step of entraining the dirt and debris includes scrubbing the surface.

5. A method for cleaning dirt and debris from a surface upon which a body can be supported, the method comprising the steps of:

sequentially moving a cleaning module along the surface in a first direction and along the surface in a second direction generally opposite the first direction;

sequentially applying first and second volumes of cleaning fluid directly to a portion of the surface while the cleaning module sequentially moves along the portion of the surface in the first and second directions, respectively;

allowing the dirt and debris to be treated with the first and second volumes of cleaning fluid to facilitate removal of the dirt and debris from the portion of the surface;

while the cleaning module moves along the portion of the surface in the first direction, recovering dirt, debris, and only the second volume of cleaning fluid previously applied to the portion of the surface during the movement of the cleaning module in the second direction; and while the cleaning module moves along the portion of the surface in the second direction, recovering dirt, debris, and only the first volume of cleaning fluid previously applied to the portion of the surface during the movement of the cleaning module in the first direction.

6. A method for cleaning a surface according to claim 5 wherein the step of sequentially applying the first and second volumes of cleaning fluid to the portion of the surface is achieved by sequentially actuating a first fluid dispenser and a second fluid dispenser.

7. A method for cleaning a surface according to claim 6 wherein the step of actuating a first fluid dispenser is performed during movement of the cleaning module in the first direction, and the step of actuating a second fluid dispenser is performed during movement of the cleaning module in the second direction.

8. A method for cleaning a surface according to claim 7 wherein the step of sequentially actuating a fluid dispenser is performed so that movement of the cleaning module moves an extraction nozzle along the surface ahead of the actuating fluid dispenser.

9. A method for cleaning a surface according to claim 5 wherein the step of treating the dirt and debris includes scrubbing the portion of the surface.

10. A method for cleaning a surface according to claim 5 wherein the step of treating the dirt and debris includes entraining the dirt and debris in the cleaning fluid.

11. A method for treating a surface upon which a body can be supported, the method comprising the steps of:

traversing a portion of the surface along a first direction while applying a first volume of fluid to the portion of the surface;

subsequently traversing the portion of the surface along a second direction generally opposite the first direction while applying a second volume of fluid to the portion of the surface;

while traversing the portion of the surface along the first direction and applying the first volume of fluid to the portion of the surface, contemporaneously extracting only fluid applied to the portion of the surface while traversing along the second direction; and while traversing the portion of the surface along the second direction and applying the second volume of fluid to the portion of the surface, contemporaneously extracting only fluid applied to the portion of the surface while traversing along the first direction.

12. A method for treating a surface according to claim 11, and further comprising the steps of leaving the second volume of fluid on the portion of the surface while extracting the first volume of fluid from the surface, and leaving the first volume of fluid on the portion of the surface while extracting the second volume of fluid from the portion of the surface.

* * * * *